US006503347B1

(12) United States Patent
Wysiekierski et al.

(10) Patent No.: US 6,503,347 B1
(45) **Date of Patent: *Jan. 7, 2003**

(54) SURFACE ALLOYED HIGH TEMPERATURE ALLOYS

(75) Inventors: Andrew George Wysiekierski, Okanagan Falls (CA); Gary Anthony Fisher, Edmonton (CA); Sabino Steven Anthony Petrone, Edmonton (CA); Radhakrishna Chakravarthy Mandyam, Agoura Hills, CA (US)

(73) Assignee: Surface Engineered Products Corporation, Fort Saskatchewan (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/577,597

(22) Filed: May 25, 2000

(Under 37 CFR 1.47)

Related U.S. Application Data

(63) Continuation-in-part of application No. 08/839,831, filed on Apr. 17, 1997, now Pat. No. 6,093,260.

(30) Foreign Application Priority Data

Apr. 30, 1996 (CA) ..... 2175439

(51) Int. Cl.[7] ..... C23C 2/28; C23C 22/72; C23C 22/82

(52) U.S. Cl. ..... 148/512; 148/527; 148/530

(58) Field of Search ..... 148/277, 512, 148/527, 529, 530

(56) References Cited

U.S. PATENT DOCUMENTS

| | | | |
|---|---|---|---|
| 4,156,042 | A | 5/1979 | Hayman et al. |
| 4,468,308 | A | 8/1984 | Scovell |
| 4,516,716 | A | 5/1985 | Coad |

(List continued on next page.)

FOREIGN PATENT DOCUMENTS

| | | |
|---|---|---|
| DE | 2820699 A1 | 11/1978 |
| EP | 219960 | 1/1986 |
| EP | 423345 | 4/1991 |
| FR | 900427 | 10/1951 |
| FR | 1584370 | 12/1969 |
| FR | 2511396 | 2/19832 |

(List continued on next page.)

OTHER PUBLICATIONS

The Effect of Time at Temperature on "Silicon–Titanium" Diffusion Coating on IN738 Base Alloy by M.C. Meelu and M.H. Loretto pp. 1241–1246 of Processing and Properties of Materials, No Date.

CVD Application of Anti–Thermal and Anti–Corrosive Silica Films to the Inner Walls of Steel Tubes by Kohzo Sugiyama and Tomonori Nagashima pp. 36–40 of J. Met. Finish. Soc. Japan—Jul. 1988, 39(7) 388–392.

The Effectiveness of Vapour–deposited $SiO_2$ Coatings in Preventing Carburization of Incoly 800H by E. Lang pp. 37–45 Materials of Science and Engineering, 88 (1987).

(List continued on next page.)

*Primary Examiner*—George Wyszomierski
(74) *Attorney, Agent, or Firm*—Arne I. Fors

(57) ABSTRACT

There is provided a surface alloyed component which comprises a base alloy with a diffusion barrier layer enriched in silicon and chromium being provided adjacent thereto. An enrichment pool layer is created adjacent the diffusion barrier and contains silicon and chromium and optionally titanium or aluminum. The method comprises depositing a surface alloy on the base alloy at a temperature in the range of 400 to 1000° C. and heat treating the surface alloy at a ramp temperature rate of at least 5C°/minute, preferably 10 to 20° C./minute, to a desired maximum temperature at which the surface alloyed component is maintained for a time sufficient to provide the enrichment pool or the enrichment pool with a diffusion barrier layer. A reactive gas treatment may be used to generate a replenishable protective oxide scale of alumina or chromia on the outermost surface of the surface alloyed component.

50 Claims, 9 Drawing Sheets

U.S. PATENT DOCUMENTS

| | | | | | |
|---|---|---|---|---|---|
| RE32,121 | E | | 4/1986 | Gupta et al. | |
| 4,714,632 | A | | 12/1987 | Cabrera et al. | |
| 4,737,381 | A | | 4/1988 | Kilbane et al. | |
| 4,929,473 | A | | 5/1990 | Marquez et al. | |
| 4,944,858 | A | | 7/1990 | Murphy et al. | |
| 5,128,179 | A | | 7/1992 | Baldi | |
| 5,139,824 | A | | 8/1992 | Liburdi et al. | |
| 5,208,069 | A | | 5/1993 | Clark et al. | |
| 5,223,045 | A | * | 6/1993 | Priceman | 148/277 |
| 5,224,998 | A | | 7/1993 | Ohmi et al. | |
| 5,265,793 | A | | 11/1993 | Usui et al. | |
| 5,270,081 | A | | 12/1993 | Manier et al. | |
| 5,334,416 | A | | 8/1994 | Seong et al. | |
| 5,364,659 | A | | 11/1994 | Rapp et al. | |
| 5,366,765 | A | | 11/1994 | Milaniak et al. | |
| 5,387,292 | A | | 2/1995 | Morishige et al. | |
| 5,403,629 | A | | 4/1995 | Eichmann et al. | |
| 5,413,642 | A | | 5/1995 | Alger et al. | |
| 5,413,700 | A | | 5/1995 | Heyse et al. | |
| 5,413,813 | A | | 5/1995 | Clark et al. | |
| 5,795,659 | A | | 8/1998 | Meelu et al. | |
| 5,873,951 | A | | 2/1999 | Wynns et al. | |
| 6,093,260 | A | * | 7/2000 | Petrone et al. | 148/277 |

FOREIGN PATENT DOCUMENTS

| | | | | |
|---|---|---|---|---|
| GB | 1018628 | | 1/1966 | |
| GB | 1483144 | | 4/1975 | |
| GB | 2233672 | | 6/1990 | |
| GB | 2234530 | | 6/1990 | |
| JP | 60 005 927 | | 1/1985 | |
| JP | 61272389 | A | 12/1986 | |
| JP | 62-74063 | A * | 4/1987 | 148/277 |
| JP | 6-10114 | | 1/1994 | |
| SU | 986961 | | 1/1983 | |
| SU | 1502658 | | 8/1989 | |

OTHER PUBLICATIONS

A Replacement for Sulfur Treatment in Ethane Cracking Paper written by R.E. Brown et al. Presented at AIChE Spring Meeting, Apr. 1994.

The Coating of Internal Surfaces by PVD Techniques by J.A. Sheward Surface and Coatings Technology, 54/55 (1992) 297–302.

Amoco Anticoking Technology A Process for Inhibiting Coking in Pyrolysis Furnaces Paper written by D.M. Taylor et al. Presented at AZChE Spring Meeting, Apr. 1994.

Metal Science and Heat Treatment, vol. 26, No. 9/10 New York, U.S.A. pp. 764–768 Oct. 1984.

Cylindrical Magnetron Sputtering—John A. Thronton & Alan S. Penfold 1978 by Academic Press, Inc.

Chemical Abstracts, vol. 68, No. 12 Columbus, Ohio, U.S.—Abstract No. 52538 Mar. 1968.

Erosion and Erosion–Corrosion Behavior of Chromized–Siliconized Steel by B.Q. Wang et al. No Date.

* cited by examiner

16B
Si-Al/Ti/Si

10D
Unrifled & Untrtd.

(A) Below the critical temperature range

SURFACE ALLOYED HIGH TEMPERATURE ALLOYS

This application is a continuation-in-part of application Ser. No. 08/839,831 filed Apr. 17, 1997, now U.S. Pat. No. 6,093,260

BACKGROUND OF THE INVENTION (i) Field of the Invention

The present invention relates to coating systems for the generation of protective surface alloys for high temperature metal alloy products. More specifically, the coating systems generate surface alloys having controlled microstructures functional to impart predetermined beneficial properties to said alloy products including enhanced coking resistance, carburization resistance and product longevity.

(ii) Description of the Related Art

Stainless steels are a group of alloys based on iron, nickel and chromium as the major constituents, with additives that can include carbon, tungsten, niobium, titanium, molybdenum, manganese, and silicon to achieve specific structures and properties. The major types are known as martensitic, ferritic, duplex and austenitic steels. Austenitic stainless generally is used where both high strength and high corrosion resistance is required. One group of such steels is known collectively as high temperature alloys (HTAs) and is used in industrial processes that operate at elevated temperatures generally above 650° C. and extending to the temperature limits of ferrous metallurgy at about 1150° C. The major austenitic alloys used have a composition of chromium, nickel and iron in the range of 18 to 38 wt. % chromium, 18 to 48 wt. % nickel, balance iron and alloying additives.

The bulk composition of HTAs is engineered towards physical properties such as creep resistance and strength, and chemical properties of the surface such as corrosion resistance. Corrosion takes many forms depending on the operating environment and includes carburization, oxidation and sulfidation. Protection of the bulk alloy is often provided by the surface being enriched in chromium oxide. The specific compositions of the alloys used represent an optimization of physical properties (bulk) and chemical properties (surface). The ability of addressing the chemical properties of the surface through a surface alloy, and physical properties through the bulk composition, would provide great opportunities for improving materials performance in many severe service industrial environments.

Surface alloying can be carried out using a variety of coating processes to deliver the right combination of materials to the component's surface at an appropriate rate. These materials would need to be alloyed with the bulk matrix in a controlled manner that results in a microstructure capable of providing the pre-engineered or desired benefits. This would require control of the relative interdiffusion of all constituents and the overall phase evolution. Once formed, the surface alloy can be activated and reactivated, as required, by a reactive gas thermal treatment. Since both the surface alloying and the surface activation require considerable mobility of atomic constituents, that is, temperatures greater than 700° C., HTA products can benefit most from the procedure due to their designed ability of operating at elevated temperatures. The procedure can also be used on products designed for lower operating temperatures, but may require a post heat treatment after surface alloying and activation to reestablish physical properties.

Surface alloys or coating systems can be engineered to provide a full range of benefits to the end user, starting with a commercial base alloy chemical composition and tailoring the coating system to meet specific performance requirements. Some of the properties that can be engineered into such systems include: superior hot gas corrosion resistance (carburization, oxidation, sulfidation); controlled catalytic activity; and hot erosion resistance.

Two metal oxides are mainly used to protect alloys at high temperatures, namely chromia and alumina, or a mixture of the two. The compositions of stainless steels for high temperature use are tailored to provide a balance between good mechanical properties and good resistance to oxidation and corrosion. Compositions which can provide an alumina scale are favoured when good oxidation resistance is required, whereas compositions capable of forming a chromia scale are selected for resistance to hot corrosive conditions. Unfortunately, the addition of high levels of aluminum and chromium to the bulk alloy is not compatible with retaining good mechanical properties and coatings containing aluminum and/or chromium are normally applied onto the bulk alloy to provide the desired surface oxide.

One of the most severe industrial processes from a materials perspective is the manufacture of olefins such as ethylene by hydrocarbon steam pyrolysis (cracking). Hydrocarbon feedstock such as ethane, propane, butane or naphtha is mixed with steam and passed through a furnace coil made from welded tubes and fittings. The coil is heated on the outerwall and the heat is conducted to the innerwall surface leading to the pyrolysis of the hydrocarbon feed to produce the desired product mix at temperatures in the range of 850 to 1100° C. An undesirable side effect of the process is the buildup of coke (carbon) on the innerwall surface of the coil. There are two major types of coke: catalytic coke (or filamentous coke) that grows in long threads when promoted by a catalyst such as nickel or iron, and amorphous coke that forms in the gas phase and plates out from the gas stream. In light feedstock cracking, catalytic coke can account for 80 to 90% of the deposit and provides a large surface area for collecting amorphous coke.

The coke can act as a thermal insulator, requiring a continuous increase in the tube outerwall temperature to maintain throughput. A point is reached when the coke buildup is so severe that the tube skin temperature cannot be raised any further and the furnace coil is taken offline to remove the coke by burning it off (decoking). The decoking operation typically lasts for 24 to 96 hours and is necessary once every 10 to 90 days for light feedstock furnaces and considerably longer for heavy feedstock operations. During a decoke period, there is no marketable production which represents a major economic loss. Additionally, the decoke process degrades tubes at an accelerated rate, leading to a shortened lifetime. In addition to inefficiencies introduced to the operation, the formation of coke also leads to accelerated carburization, other forms of corrosion, and erosion of the tube innerwall. The carburization results from the diffusion of carbon into the steel forming brittle carbide phases. This process leads to volume expansion and the embrittlement results in loss of strength and possible crack initiation. With increasing carburization, the alloy's ability of providing some coking resistance through the formation of a chromium based scale deteriorates. At normal operating temperatures, half of the wall thickness of some steel tube alloys can be carburized in as little as two years of service. Typical tube lifetimes range from 3 to 6 years.

It has been demonstrated that aluminized steels, silica coated steels, and steel surfaces enriched in manganese oxides or chromium oxides are beneficial in reducing catalytic coke formation. Alonizing™, or aluminizing, involves the diffusion of aluminum into the alloy surface by pack cementation, a chemical vapour deposition technique. The coating is functional to form a NiAl type compound and provides an alumina scale which is effective in reducing catalytic coke formation and protecting from oxidation and other forms of corrosion. The coating is not stable at temperatures such as those used in ethylene furnaces, and also is brittle, exhibiting a tendency to spall or diffuse into the base alloy matrix. Generally, pack cementation is limited to the deposition of one or two elements, the co-deposition of multide elements, being extremely difficult. Commercially, it is generally limited to the deposition of only a few elements, mainly aluminum. Some work has been carried out on the codeposition of two elements, for example chromium and silicon. Another approach to the application of aluminum diffusion coatings to an alloy substrate is disclosed in U.S. Pat. No. 5,403,629 issued to P. Adam et al. This patent details a process for the vapour deposition of a metallic interlayer on the surface of a metal component, for example by sputtering. An aluminum diffusion coating is thereafter deposited on the interlayer.

Alternative diffusion coatings have also been explored. In an article in "Processing and Properties" entitled "The Effect of Time at Temperature on Silicon-Titanium Diffusion Coating on IN738 Base Alloy" by M. C. Meelu and M. H. Lorretto, there is disclosed the evaluation of a Si—Ti coating, which had been applied by pack cementation at high temperatures over prolonged time periods.

A major difficulty in seeking an effective coating is the propensity of many applied coatings to fail to adhere to the tube alloy substrate under the specified high temperature operating conditions in hydrocarbon pyrolysis furnaces. Additionally, the coatings lack the necessary resistance to any or all of thermal stability, thermal shock, hot erosion, carburization, oxidation and sulfidation. A commercially viable product for olefins manufacturing by hydrocarbon steam pyrolysis must be capable of providing the necessary coking and carburization resistance over an extended operating life while exhibiting thermal stability, hot erosion resistance and thermal shock resistance.

SUMMARY OF THE INVENTION

It is therefore a principal object of the present invention to impart beneficial properties to HTAs through surface alloying to substantially eliminate or reduce the catalytic formation of coke on the internal surfaces of tubing, piping, fittings and other ancillary furnace hardware used for the manufacture of olefins by hydrocarbon steam pyrolysis or the manufacture of other hydrocarbon-based products.

It is another object of the invention to increase the carburization resistance of HTAs used for tubing, piping, fittings and ancillary furnace hardware whilst in service.

It is a further object of the invention to augment the longevity of the improved performance benefits derived from the surface alloying under commercial conditions by providing thermal stability, hot erosion resistance and thermal shock resistance.

In accordance with the present invention there are provided two distinct types of surface alloy structures, both generatable from the deposition of either of two coating formulations, Al—Ti—Cr—Si and Cr—Ti—Si, followed by appropriate heat treatments.

The first type of surface alloy is generated after the application of the coating material and an appropriate heat treatment following thereafter, forming an enrichment pool adjacent to the base alloy and containing the enrichment elements and base alloy elements such that an alumina or a chromia scale can be generated by reactive gas thermal treatment (surface activation), through the use of Al—Ti—Cr—Si and Cr—Ti—Si as the coating materials, respectively.

The second type of surface alloy is produced using Al—Ti—Cr—Si as the coating material, the heat treatment cycle being such as to produce a diffusion barrier adjacent to the base alloy and an enrichment pool adjacent said diffusion barrier. Surface activation of this type of surface alloy produces a protective scale that is mainly alumina. These scales are highly effective at reducing or eliminating catalytic coke formation. This type of surface alloy is compatible with high temperature commercial processes of up to 1100° C. such as olefins manufacturing by hydrocarbon steam pyrolysis typified by ethylene production.

The diffusion barrier is defined as a silicon and chromium enriched, reactively interdiffused layer containing intermetallics of the elements from the base alloy and the deposited materials. The enrichment pool is defined as an interdiffused layer containing the deposited materials and is adjacent to the diffusion barrier, if formed, or the base alloy, which is functional to maintain a protective oxide scale on the outermost surface.

In its broad aspect, the method of the invention for providing a protective surface on abase alloy containing iron, nickel and chromium comprises depositing onto said base alloy elemental silicon and at least one of aluminum, titanium and chromium, and optionally one of yttrium, hafnium or zirconium, and heat treating said base alloy to generate a surface alloy consisting of an enrichment pool containing said deposited elements on said base alloy.

More particularly, the method comprises depositing a surface alloy of an effective amount of elemental silicon and at least one of aluminum, titanium and chromium on the base alloy at a temperature in the range of 400 to 1100° C. and heat treating said base alloy and surface alloy at a temperature in the range of 400 to 1160° C. at a rate of temperature rise of at least 5 Celsius degrees/minute, preferably 10 to 20 Celsius degrees/minute, up to a desired maximum temperature and maintaining said maximum temperature for a time effective to provide an enrichment pool. The base alloy and surface alloy preferably are heated in a non-oxidizing atmosphere, at least through the temperature rate of 500° C. to 750° C. The enrichment pool contains 2.5 to 30 wt. % silicon, preferably 3 to 7 wt. % silicon, 0 to 10 wt. % titanium, 2 to 45 wt. % chromium and 0 to 15 wt. % aluminum, preferably 5 to 15 wt. % aluminum, the balance being iron, nickel and any base alloying additives, having a thickness in the range of 10 to 300 $\mu$m, for an alumina system. The enrichment pool contains at least 22 wt. % chromium, at least 2.5 wt. % silicon and 0 to 10 wt. % titanium, the balance being iron, nickel and any base alloying additives, for a chromia system. Preferably about 35 to 45 wt. % aluminum, a total of about 5 to 20 wt. % of at least one of titanium or chromium, and 40 to 55 wt. % silicon, and more preferably about 35 to 40 wt. % aluminum, about 5 to 15 wt. % titanium, and about 50 to 55 wt. % silicon, and most preferably about 40 wt. % aluminum, about 10 wt. % titanium and about 50 to 55 wt. % silicon, are deposited as a surface alloy onto the base alloy for an alumina system. Preferably about 40 to 50 wt. % chromium, about 40 to 50 wt. % silicon, the balance titanium for a chromia system, are deposited as a surface alloy onto the base alloy.

In a preferred embodiment, the method of the invention for the alumina Al—Ti—Si system comprises heat treating and maintaining said base alloy at a temperature in the range of 1030 to 1160° C., more preferably in the range of about 1130 to 1150° C., for a time effective to form an intermediary diffusion barrier between the base alloy substrate and the enrichment pool containing intermetallics of the deposited elements and the base alloy elements, said diffusion barrier preferably having a thickness of 10 to 300 μm and containing 4 to 20 wt. % silicon, 0 to 5 wt. % aluminum, 0 to 4 wt. % titanium, and 20 to 85 wt. % chromium, the balance iron and nickel and any alloying additives. The protective surface is reacted with an oxidizing gas selected from at least one of oxygen, air, steam, carbon monoxide or carbon dioxide, alone, or with any of hydrogen, nitrogen, hydrocarbons or argon, whereby a replenishable protective oxide scale of alumina having a thickness of about 0.5 to 10 μm is formed on said enrichment pool.

In a further embodiment of the method of the invention, up to about 1.5 wt. % yttrium, hafnium or zirconium may be added with the surface alloy composition to be heat treated to enhance the stability of the protective scale.

The base alloy and surface alloy are heated in a furnace at a rate of temperature rise of at least 5 Celsius degrees/minute, preferably in the range of 10 to 20 Celsius degrees/minute. Preheating of the furnace to a desired maximum temperature permits a rate of temperature rise of greater than 20 Celsius degrees/minute, obviating the need for a non-oxidizing atmosphere.

A surface alloy of Al—Ti—Cr—Si deposited on a base alloy containing about 31 to 38 wt. % chromium preferably is maintained and soaked at a desired maximum temperature in the range of 1130 to 1150° C., preferably in the range of 1135 to 1145° C., for at least about 20 minutes, preferably for about 30 minutes to 2 hours.

A surface alloy of about 40 wt. % aluminum, about 10 wt. % chromium, and about 50 to 55 wt. % silicon deposited on a base alloy containing about 31 to 38 wt. % chromium is maintained at a desired maximum temperature in the range of about 1130 to about 1160° C., preferably about 1140 to about 1155 ° C., for at least about 20 minutes, preferably for about 30 minutes to 2 hours.

A surface alloy of about 15 to 40 wt. % aluminum, about 5 to 15 wt. % titanium and the balance silicon deposited onto a base alloy containing about 20 to 25 wt. % chromium preferably is maintained and soaked at a desired maximum temperature in the range of about 1050 to 1080° C. for at least about 20 minutes, preferably for about 30 minutes to 2 hours.

A surface alloy of about 40 wt. % aluminum, about 10 wt. % titanium and the balance silicon deposited onto a base alloy containing about 20 to 25 wt. % chromium and about 3 wt. % molybdenum is maintained and soaked at a desired maximum temperature in the range of about 1130 to 1145° C. for at least about 20 minutes, preferably for about 30 minutes to 2 hours.

The surface alloyed component of the invention produced by the method broadly comprises a base stainless steel alloy containing iron, nickel and chromium, and an enrichment pool layer adjacent said base alloy, said enrichment pool having a thickness in the range of 10 to 300 μm, and containing silicon and aluminum with at least one of titanium and chromium, and optionally yttrium, hafnium or zirconium, with the balance iron, nickel and any base alloying additives, which have been applied to said base alloy under conditions effective to permit reactive interdiffusion between said base alloy and the deposited materials, whereby an enrichment pool is formed which is functional to form a replenishable protective oxide scale of alumina or chromia on said outermost surface of said component. The enrichment pool composition comprises silicon in the range of 2.5 to 30 wt. %, preferably 3 to 7 wt. %, titanium in the range of 0 to 10 wt. %, chromium in the range of 2 to 45 wt. %, and aluminum in the range of 0 to 15 wt. %, preferably 5 to 10 wt. %, the balance thereof being iron, nickel and any base alloying additives.

The surface alloyed component for an alumina system preferably additionally comprises a diffusion barrier layer, adjacent said base stainless steel alloy, said diffusion barrier having a thickness in the range of between 10 to 300 μm, and containing intermetallics of the deposited elements and the base alloy elements; whereby the diffusion barrier and the enrichment pool are formed which are functional to reduce diffusion of mechanically deleterious constituents into said base alloy and to form a replenishable protective scale of alumina on said outermost surface of said component. In accordance with this embodiment, the diffusion barrier layer comprises silicon in the range of 6 to 20 wt. %, preferably 6 to 10 wt. %, aluminum in the range of 0 to 5%, chromium in the range of 20 to 85 wt. %, preferably 25 to 50 wt. %, and titanium in the range of from 0 to 4 wt. %. More preferably, the surface alloy comprises an enrichment pool containing about 3 wt. % silicon and about 5 wt. % aluminum and a diffusion barrier containing about 6 wt. % silicon and 20 wt. % chromium.

In accordance with an embodiment of the method of the invention for a chromia system, a surface alloy of Cr—Ti—Si, such as a surface alloy containing 40 to 50 wt. % chromium, preferably about 40% chromium, and about 40 to 50 wt. % silicon, preferably about 50 wt. % silicon, the balance titanium in the range of 0 to 10 wt. %, preferably about 10 wt. % titanium, is deposited on a base alloy containing iron, nickel, chromium and alloying additives and heat treated at a temperature in the range of 400 to 1160° C. at a rate of temperature rise of at least 5 Celsius degrees/min, preferably at a rate of temperature rise of 10 to 20 Celsius degrees/min, to a desired maximum temperature, preferably in the range of 1150 to 1155° C., for a time sufficient to generate a surface alloy, preferably for at least 20 minutes and more preferably for about 30 minutes to 2 hours. The surface alloy contains an enrichment pool having at least 22 wt. % chromium, at least 2.5 wt. % silicon, 0 to 10 wt. % titanium with the balance thereof being iron, nickel and any base alloying additives. Preferably, the enrichment part contains 6 to 10 wt. % silicon and about 22 to 40 wt. % chromium, the balance being iron, nickel and any base alloying additives. Up to about 1.5 wt. % yttrium, hafnium or zirconium may be added with the surface alloy composition to be heat treated. The surface alloy protective surface is reacted with an oxidizing gas selected from at least one of oxygen, air, steam, carbon monoxide or carbon dioxide, alone, or with any of hydrogen, nitrogen or argon, whereby a replenishable protective oxide scale of chromia having a thickness of about 0.5 to 10 μm is formed on said enrichment pool.

DESCRIPTION OF THE DRAWINGS

The products of the invention will now be described with reference to the accompanying drawings, in which.

DESCRIPTION OF THE PREFERRED EMBODIMENT

Figure 1:
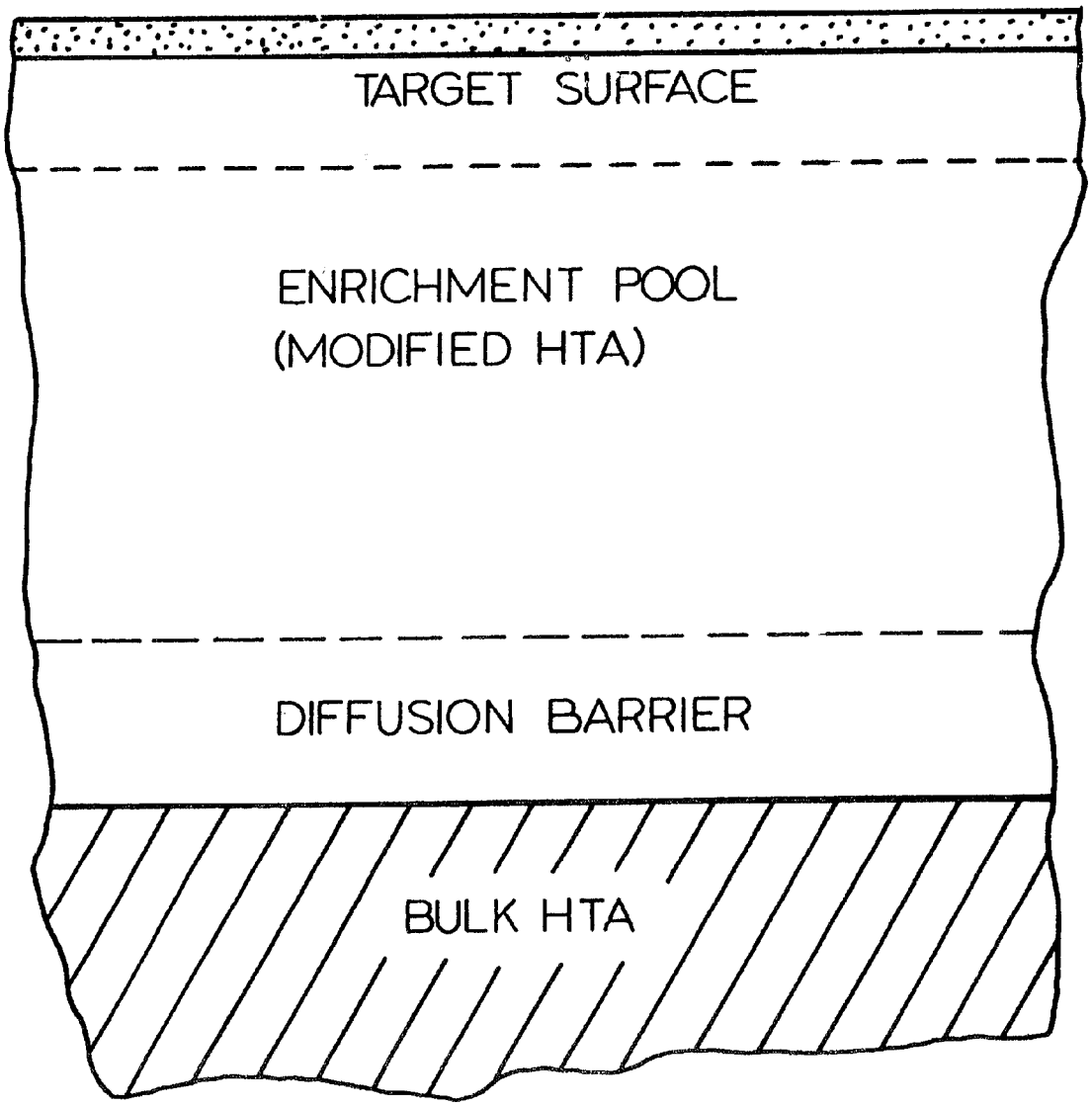
FIG. 1 is a schematic representation of a surface alloy after coating deposition, surface alloying, and surface activation.
Figure 2:
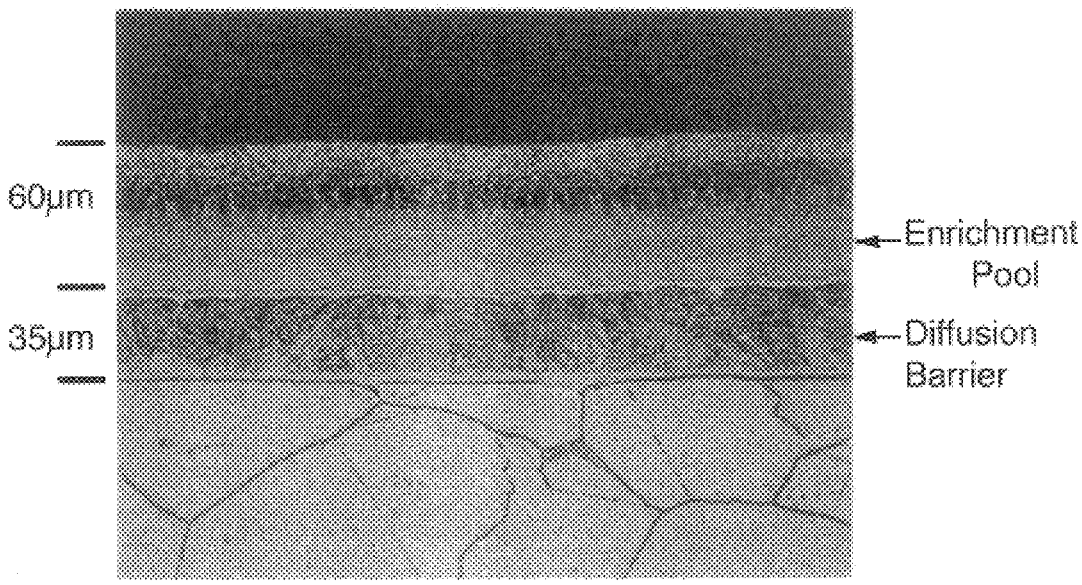
FIG. 2 is a photomicrograph depicting the microstructure of a surface alloy produced on a wrought 20Cr—30Ni—Fe alloy using the Al—Ti—Si coating formulation.
Figure 3:
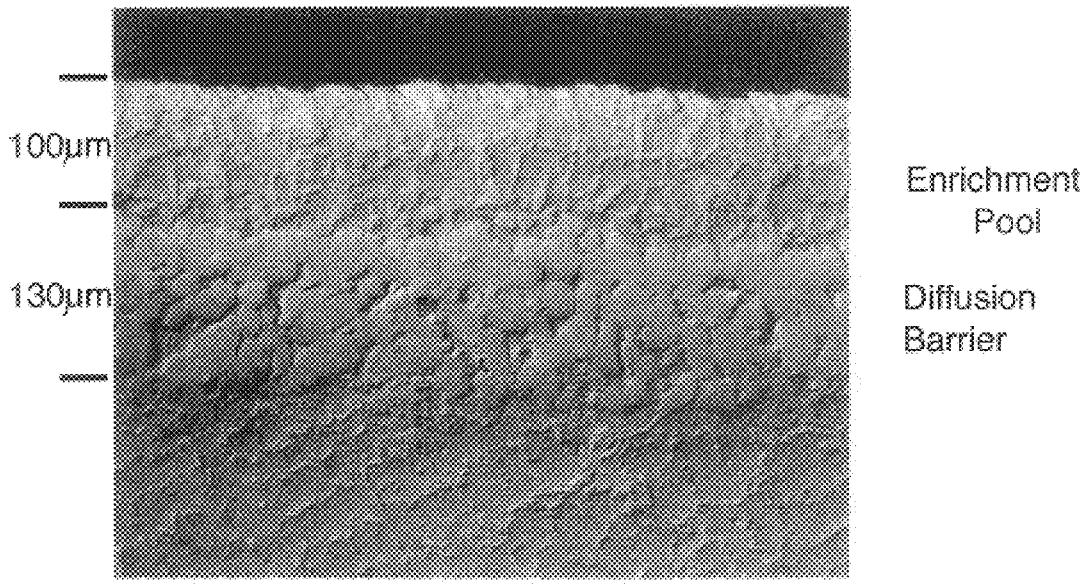
FIG. 3 is a photomicrograph depicting the microstructure of a surface alloy produced on a cast 35Cr—45Ni—Fe alloy using the Al—Ti—Si coating formulation.

Having reference to the accompanying FIGS. 1 to 3, a process for producing surface alloyed components will now be described. Suitable base alloy compositions of components to be surface alloyed would include austenitic stainless steels such as typified by a high chromium stainless steel having about 31 to 38 wt. % chromium and low chromium stainless steel having about 20 to 25 wt. % chromium.

Coating materials would be selected from elemental silicon and titanium, with one or more of aluminium and chromium, and optionally one of yttrium, hafnium or zirconium. The preferred elements are titanium, aluminum and chromium in combination with silicon. However, satisfactory surface alloys may be prepared from chromium, titanium and silicon, in combination, or from aluminum, titanium and silicon, in combination. Additionally, an initial coating of silicon may be applied followed by a coating of the above-described admixtures to further enhance silicon enrichment. The elements selected will depend upon the requisite properties of the surface alloy.

For a deposit of surface alloy on the base alloy for the Al—Ti—Si combination, aluminum would range from 15 to 50 wt. %, preferably 35 to 45 wt. %, titanium and/or chromium would range for a total of from 5 to 20 wt. %, optionally up to about 1.5 wt. % of yttrium, hafnium or zirconium, and the balance silicon, preferably 40 to 55 wt. % silicon. More preferably, the surface alloy contains about 40 to 45 wt. % aluminum, a total of about 8 to 15 wt. % titanium and/or chromium, about 45 to 50 wt. % silicon, and about 0.25 to 1 wt. % yttrium.

For the Cr—Ti—Si combination, chromium would range from 40 to 50 wt. %, titanium would range from 0 to 10 wt. % and the balance silicon, preferably 40 to 50 wt. % silicon.

Typical ranges for the average composition of the surface alloy layers formed on a wrought 20Cr—30Ni—Fe alloy using Al—Ti—Si are shown in Table I.

TABLE I

| Wt. % | Diffusion Barrier | Enrichment Pool |
|---|---|---|
| Aluminum | 0 to 2 | 5 to 15 |
| Chromium | 20 to 50 | 2 to 10 |
| Silicon | 6 to 10 | 5 to 30 |
| Titanium | 0 to 2 | 5 to 10 |
| Iron, Nickel | Balance | Balance |

Typical ranges for the average composition of the surface alloy layers formed on a cast 35Cr—45Ni—Fe (supplier B) alloy using Al—Ti—Si are shown in Table II.

TABLE II

| Wt. % | Diffusion Barrier | Enrichment Pool |
|---|---|---|
| Aluminum | 0 to 5 | 4 to 15 |
| Chromium | 25 to 85 | 10 to 45 |
| Silicon | 4 to 20 | 2.5 to 15 |
| Titanium | 0 to 2 | 0 to 5 |
| Iron, Nickel | Balance | Balance |

It is to be noted that one of the advantages of the above-described coating is that a Ni:Ti:Si ratio of 4:2:1 respectively is functional to form a very stable compound in conjunction with the other elements. This stable coating does not diffuse into the substrate and maintains a high titanium and silicon content near the surface.

The coating materials may be delivered to the surface of the component by a variety of methods whose selection is based on the composition of the coating, the temperature of the deposition, the required flux at the surface, the level of special homogeneity needed, and the shape of the component to be coated. The major coating technologies are identified below.

Thermal Spray methods include flame spray, plasma spray, high velocity oxy fuel (HVOF), and Low Pressure Plasma Spray (LPPS). They are all generally line-of-sight and are best suited for external surfaces. The use of robotic technology has improved their throwing power somewhat. New gun technologies have also been developed capable of coating the internal surfaces of piping products which are greater than 100 mm in inner diameter and lengths exceeding 5 metres.

Electrochemical and electroless methods have good throwing power for complex shapes but are limited in the range of elements which can be deposited.

Vapour based methods include pack cementation, thermal chemical vapour deposition (CVD), plasma enhanced chemical vapour deposition (PECVD), and physical vapour deposition (PVD). PVD methods are very diverse and include cathodic arc, sputtering (DC, RF, magnetron), and electron beam evaporation.

Other coating methods include sol gel and fluidized bed processes with the former capable of delivering a wide range of coating materials to both simple shaped and complex shaped components.

Hybrid methods combine more than one of the above to ensure that the engineered surface alloy microstructure can be generated from the constituent materials delivered, for example, CVD, followed by PVD, or electrochemical followed by PVD.

Each of the above methods has capabilities and limitations that define its applicability for the performance enhancement of the component required. The key delivery requirements of any method considered for a given coating formulation are geometry of the component to be coated, throwing power of the method, rate of deposition and uniformity of deposition.

All of the above methods can be used for delivery of coating materials to the external surfaces of a wide range of component geometries, each with well defined throwing power. The preferred methods for delivering a wide range of coating materials to the internal surfaces of complex shaped parts are PVD methods. This is due to the flexibility in the selection of consumable (coating) material, and the ability of assembling the coating consumable within the complex shaped part. An example in the coating of tubular products is given by J. S. Sheward entitled "The Coating of Internal Surfaces by PVD Techniques" published in the Proceedings of the 19th International Conference on Metallurgical Coatings and Thin Films, San Diego, Apr. 6–10, 1992.

The use of magnetron sputtering is well known in the art and detailed in the review by J. A. Thornton and A. S. Penfold entitled "Cylindrical Magnetron Sputtering" in Thin Film Processes, Academic Press (1987). Specific examples in the patent literature included U.S. Pat. Nos. 4,376,025 and 4,407,713 issued to B. Zega entitled "Cylindrical Cathode for Magnetically-Enhanced Sputtering" and "Cylindrical Magnetron Sputtering Cathode and Apparatus" respectively, and U.S. Pat. No. 5,298,137 to J. Marshall entitled "Method and Apparatus for Linear Magnetron Sputtering", claimed to enhance the uniformity of deposition.

In this invention, the production of a surface alloyed component is divided into four major steps:

(a) prefinishing, to generate a clean surface compatible with vapour based coating methods;

(b) coating deposition, to deliver the required coating materials for surface alloying;

(c) surface alloying, to generate a specific or pre-engineered microstructure; and (d) surface activation, to generate a protective scale by reactive gas treatment.

Steps (a) through (c) are required, step (d) is optional, as will be described below.

In step (a), prefinishing, a combination of chemical, electrochemical and mechanical methods are used to remove organic and inorganic contaminants, any oxide scale, and where present, the Bielby layer (a damage zone formed through cold working production processes). The prefinishing sequence used is defined by the bulk composition, the surface composition, and the component geometry. The thoroughness and uniformity of the prefinishing sequence is critical to the overall quality of the coated and surface alloyed product. The base alloy to be coated may be heated in a vacuum or under an inert atmosphere up to about 1100° C. prior to coating deposition to clean the base alloy surface.

For step (b), coating deposition, the preferred methods of coating the innerwall surfaces of components such as tubing, piping and fittings are sputtering (DC or RF), with or without magnetron enhancement, and PECVD. Method selection is driven mainly by the composition of the coating material to be delivered to the component surface. With sputtering methods, magnetron enhancement can be used to reduce the overall coating time per component. In such cases, the target (or cathode) is prepared by applying the coating formulation on a support tube which has the shape of the component to be coated and a diameter less than that of the component. The support tube with the coating consumable material is then inserted within the component in a manner capable of delivering coating material uniformly. Application methods of the coating consumable onto the support tubing can include any of the coating methods previously listed. Thermal spray methods were found to be the most useful for the range of coating materials required for components processed for the olefins manufacturing application. Magnetron enhancement of the sputtering process was carried out using either permanent magnets within the support tube or passing a high DC or AC current through the support tube to generate an appropriate magnetic field. The latter approach is based on electromagnetic theory specifying that the flow of an electric current through a conductor leads to the formation of circular magnetic induction lines normal to the direction of current flow for example, D. Halliday and R. Resnick, "Physics Part II" published by John Wiley & Sons, Inc. (1962). When using permanent magnets to generate the field, the composition of the support tube is unimportant, however, when using a high current, the support tube should be made of materials with low electrical resistance such as copper or aluminum. The process gas normally used is argon at pressures ranging from 1 to 200 mtorr, and if required, low levels of hydrogen (less than 5%) are added to provide a slightly reducing atmosphere. The component temperature during deposition is typically in the range of 300 to 1100° C.

There is a requirement for the deposited coating to have an adequate compositional homogeneity measured along and across the surface of the coating to allow the steps described above to properly occur. This means that the composition of the deposited coating must not deviate beyond the prescribed composition over a distance greater than that over which homogenizing diffusion of species in a direction parallel to the coating surface can occur in a time commensurate with the heat treatment process. This places some constraints upon the method used to deposit the coating. Various coating methods such as described above are feasible, provided that they maintain the constituents in a reduced (non-oxidized) state. Viable methods include physical vapour deposition including sputtering and evaporation, chemical vapour deposition, plasma assisted chemical vapour deposition and thermal or plasma spraying. Pack cementation methods in which deposition and heat treatment are combined in a single step may be acceptable, provided that the conditions outlined above are met.

For step (c), surface alloying can be initiated in part or carried out in parallel to the deposition operation by depositing at sufficiently high temperatures of greater than 600° C. with well defined temperature-time profiles, or it can be carried out upon completion of the deposition in the temperature range of 600 to 1160° C.

Step (d), surface activation, is considered optional in that the unactivated surface alloy can provide many of the targeted benefits, including coking resistance to some level. However, proper or complete activation can further increase overall coking resistance through the formation of a superior outermost scale. Activation can be carried out as part of the production process, or with the surface alloyed component in service, the latter being useful in regeneration of the protective scale if consumed (eroded) or damaged. When activation is carried out as part of the production process, it can be initiated during the surface alloying step, or after its completion. The process is carried out by reactive gas thermal treatment in the temperature range of 600 to 1100° C.

The alumina forming surface alloy coatings have three layers including an alumina layer on top having a thickness in the range of about 0.5 to 10 $\mu$m, an enrichment pool layer having a thickness in the range of 10 to 300 $\mu$m, preferably 120 to 200 μm, and a diffusion barrier layer having a thickness in the range of 10 to 300 μm, preferably 60 to 200 μm. The processes to make the alumina forming coatings are designed to provide a final coating having an average elemental composition, measured from the top surface to the bottom of the enrichment pool, of 2.5 to 30 wt. % silicon and about 4 to 15% aluminum. Preferably, the silicon content should be in the range of 3 to 7 wt. % and the aluminum content should be in the range of 5 to 10 wt. %. If the aluminum content is below about 5 wt. % the top oxide layer may not be primarily alumina, and the coking suppression may be reduced.

The silicon content of the diffusion barrier layer is 6 to 20 wt. %, preferably 6 to 10 wt. %, with a chromium content of 20 to 85 wt. %, preferably 25 to 50 wt. %, with the balance largely iron and nickel and base alloying additives. A typical composition for the diffusion barrier layer is by weight 49% chromium, 24% nickel, 18% iron, 6% silicon, 1% niobium, 0.5% titanium, 0.3% manganese and 0.3% aluminum. A silicon content of at least about 6 wt. % in the diffusion barrier layer is required to minimize carbon diffusion into the base alloy and to maintain the integrity of the enrichment pool containing aluminum. The chromium is derived from the base alloy, or as a component of the deposited coating. Typically the base alloy will contain less than 2 wt. % silicon to render it capable of being welded.

A third component element is added to the deposited coating to prevent the coating from flowing or dripping from the base alloy during heat treatment. This can be titanium, chromium .or any other element known in the art to cause the coating to remain in a solid phrase about the 590° C. eutectic temperature of the aluminum silicon binary alloy and below the temperature at which the deposited coating effectively reacts with the base alloy to form the final coating. The third element should be selected so that it does not degrade the properties of the final coating. Without the added third element, the deposited binary alloy will exist in a two phase solid-liquid state that can flow above the eutectic temperature before it reacts with the base alloy to form the final coating. The addition of the third element is less critical if the deposited coating is less than about 100 μm thick, as, in this case, the surface tension between the deposited coating and the base alloy is sufficient to prevent the deposited coating from flowing under the influence of gravity.

The alumina forming coatings require precise heat treatment to form an adequately stratified and adherent final coating. Coatings comprising for example 10 wt. % titanium, 40 wt. % aluminum and 50 wt. % silicon are deposited in the temperature range 400° to 500° C. and preferably at about 450° C. using sputtering as the deposition process. It is possible to deposit the coating at temperatures of up to 1000° C., but unless subsequent thermal processing is done in the same furnace, there is little incentive to coat at these higher temperatures. During the subsequent thermal treatment a sequence of reactions as outlined below occur. During the treatment, the rate of temperature rise must be at least 5° C. per minute from about 500° C. to within 5° C. of the maximum temperature. The maximum rate of temperature rise, i.e. ramp temperature rate, is usually determined by the heating power and the thermal mass of the furnace in which the heating is done, but it is also possible to preheat the furnace to the peak temperature and then load the parts to be coated into the furnace so that they heat more quickly than if they were loaded into a cold or partially heated furnace. Once the maximum temperature is reached the temperature must be kept within 10° C. and preferably within 5° C. of that temperature until the coating assumes its final structure, typically in about two hours. The heating rate is typically in the range of 10° C. to 20° C. per minute, but may be higher if the furnace is preheated. The process atmosphere is an inert gas such as argon or a vacuum at a pressure of about 1 torr. At the outset, and up to 1100° C., the residual gas at this pressure preferably is mainly hydrogen. Changes in the proportion of elements in the deposited coating require minor adjustments to the final temperature, typically about 5° C., but up to about 100° C. in some cases. Preferably the base alloy is heated in vacuum or under inert atmosphere to about 1100° C. in a separate step prior to coating to clean it, as is known in the vacuum coating art.

The preferred maximum temperature is dependent upon the composition of the base alloy. Although it is understood that we are not bound by hypothetical considerations, it is believed, for base alloys containing a minimum of about 31 wt. % chromium, typically 31–38 wt. % chromium, the following heating profile provides optimum results. As heating of the coated base alloy begins, no discernable reaction takes place until the temperature reaches about 500° C. Accordingly, no protective atmosphere is required up to this temperature.

Between about 500° C. and about 750° C., aluminum diffuses from the deposited coating into the base alloy, leaving a porous matrix on the surface that is depleted of aluminum and is rich in titanium and silicon. At this stage, the coating is vulnerable to oxidation and spalling. Accordingly, the temperature ramp rate must be maintained above the minimum value and an inert atmosphere or vacuum environment is preferred as the temperature passes through this range. An air atmosphere will provide satisfactory if somewhat lower performance coating if the heating rate through this temperature range is sufficiently high, e.g. over 20° C. per minute, to prevent significant reaction of the coating with oxygen or nitrogen.

Between about 750° C. and about 800° C., silicon begins to diffuse into the base alloy, penetrating deeper than the aluminum. This is because the aluminum tends to be tied up in the form of nickel aluminides at a depth where there is a substantial presence of chromium, whereas silicon is not so inhibited. These processes leave a titanium nickel silicon composition at the surface of the coating. When the temperature reaches about 800° C., essentially all of the silicon has migrated into the base alloy. Maintenance of an inert atmosphere or vacuum is no longer required in this or higher temperature ranges.

Between about 800° C. and 1000° C., the diffusion of aluminum and silicon continues deeper into the base alloy. In the aluminum rich region above the silicon rich region, excess chromium is rejected, resulting in a layer of aluminides containing no more than 25 to 28 wt. % chromium. The excess chromium reacts with silicon in the region below, forming the diffusion barrier. The diffusion barrier is very thin at this stage, typically 10 to 20 μm thick, and contains in the range of 70 to 80 wt. % chromium, and about 5–10 wt. % silicon, the balance nickel and iron and any base alloying additives.

Between about 1000° C. and 1130° C., silicon continues to migrate down into the base alloy where it reacts with chromium carbides in the base alloy. The chromium from the carbides diffuses into silicon rich areas with a tendency to leave voids where the carbides were situated. To minimize void formation, it is desirable to pass through this temperature range quickly to minimize the silicon concentration in the silicon rich areas, and hence minimize void growth.

Figure 5:
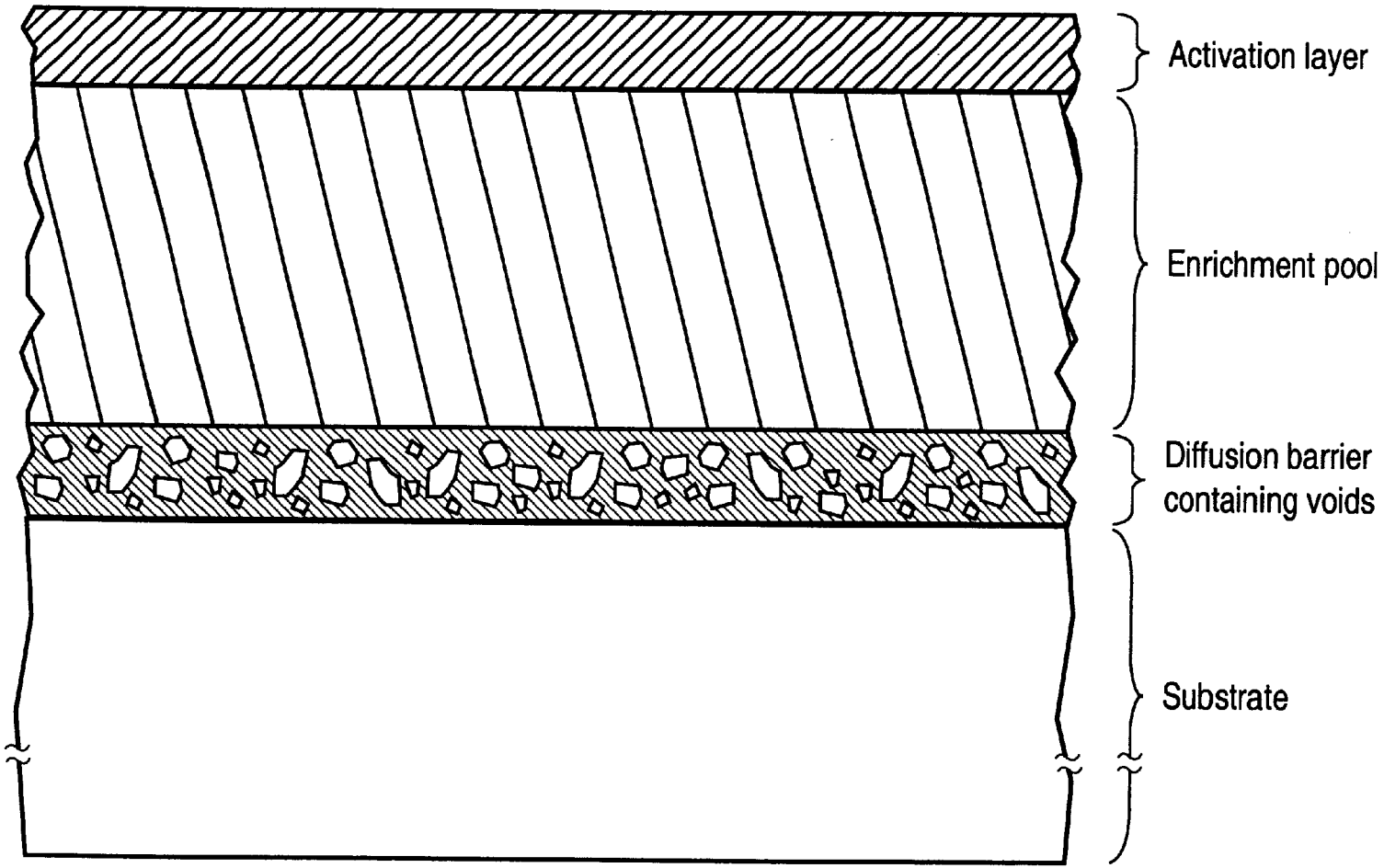
FIG. 5 is a schematic cross-section view of an Al—Ti—Si coating of the invention during heat treatment before final heat treatment.
Figure 6:
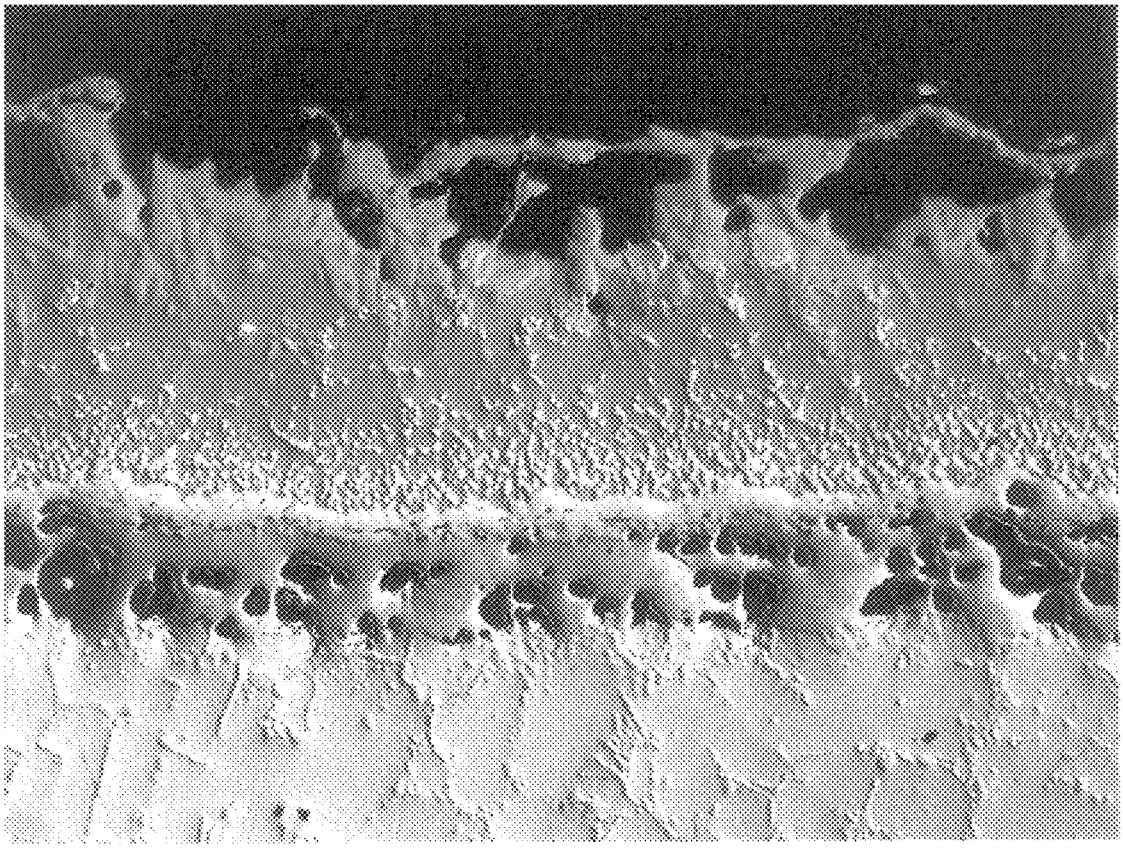
FIG. 6 is a photomicrograph of the microstructure of the alloy cross-section depicted in FIG. 5.

Small voids can be tolerated because they tend to collapse due to in-diffusion of atomic species at higher temperature, but larger voids as typified as FIGS. 5 and 6 will lead to delamination of the coating structure.

Figure 7:
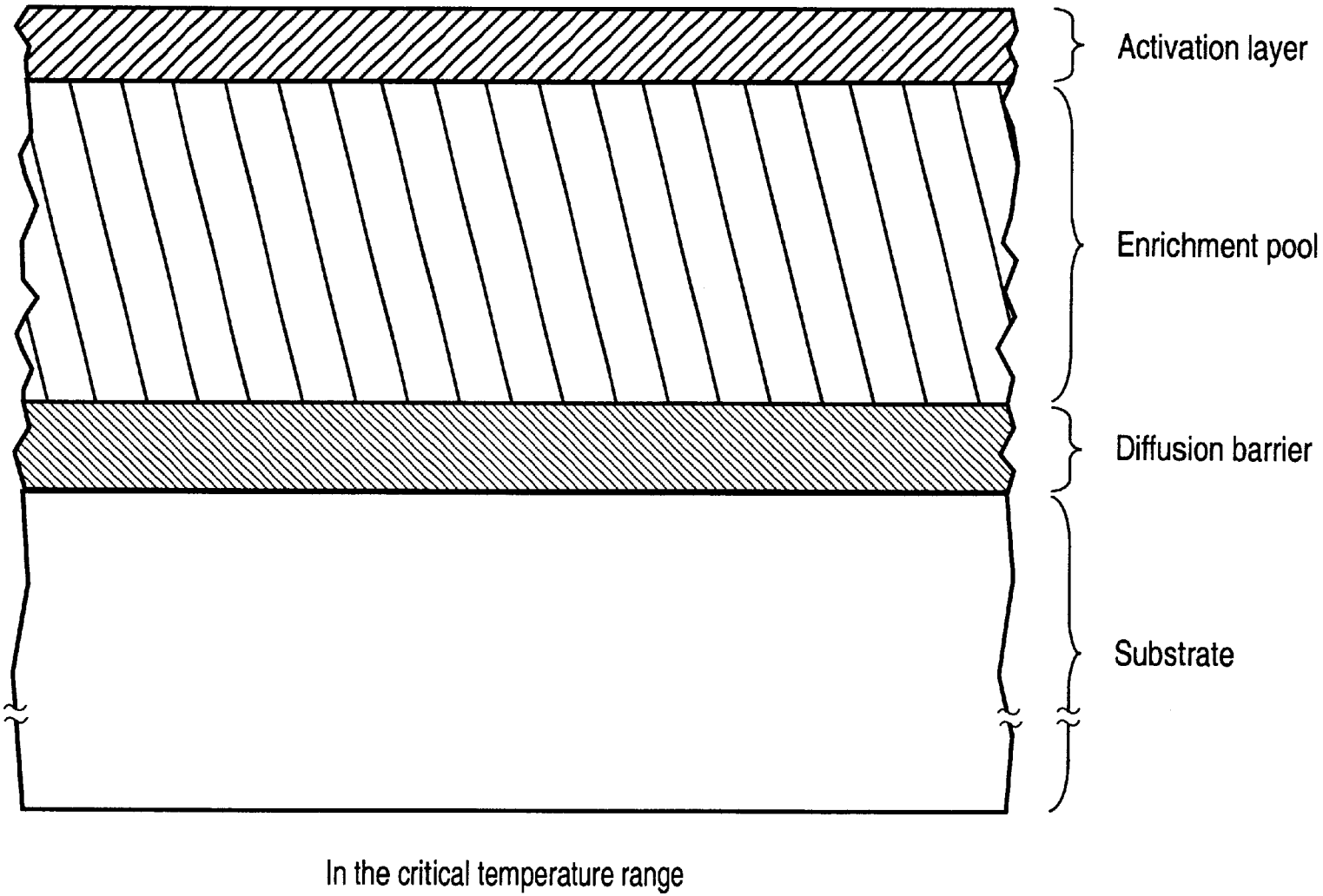
FIG. 7 is a schematic cross-section view of an Al—Ti—Si coating of the invention shown in FIGS. 5 and 6 after heating in the final heat treatment critical temperature range.
Figure 8:
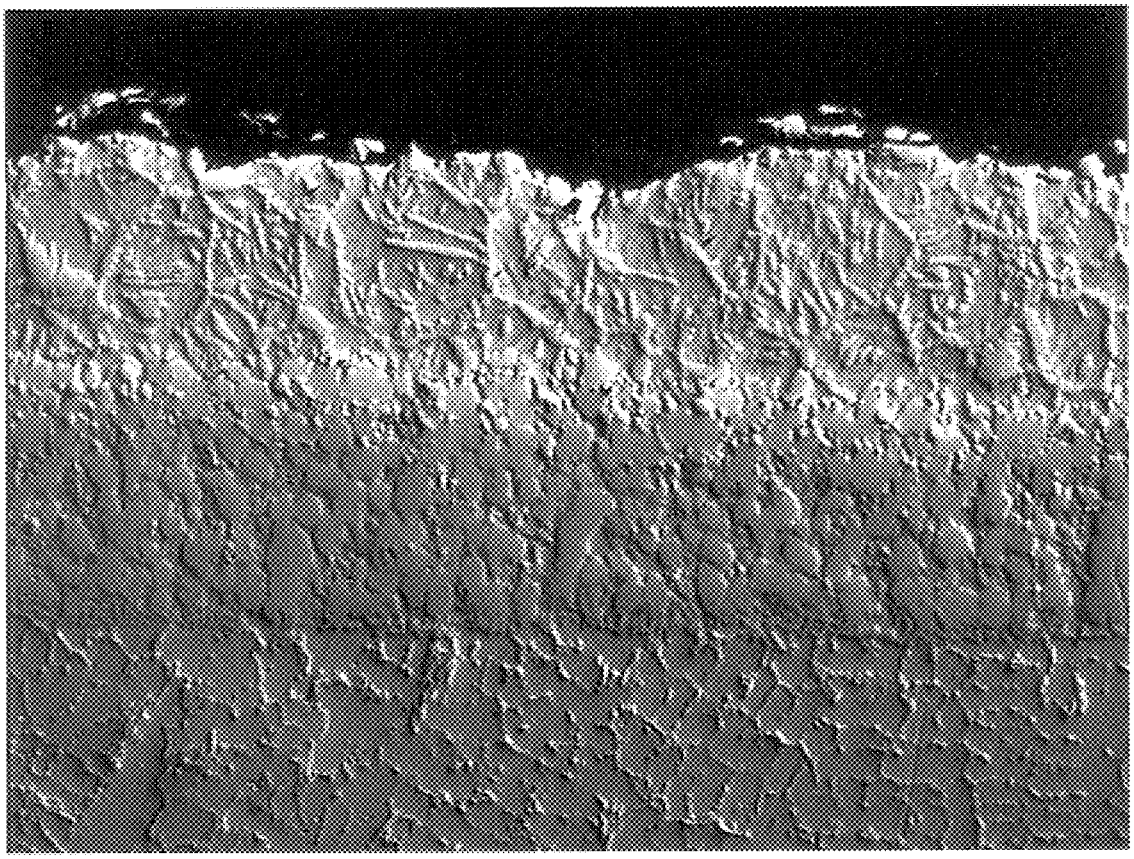
FIG. 8 is a photomicrograph of the microstructure of the alloy cross-section depicted in FIG. 7.
Figure 9:
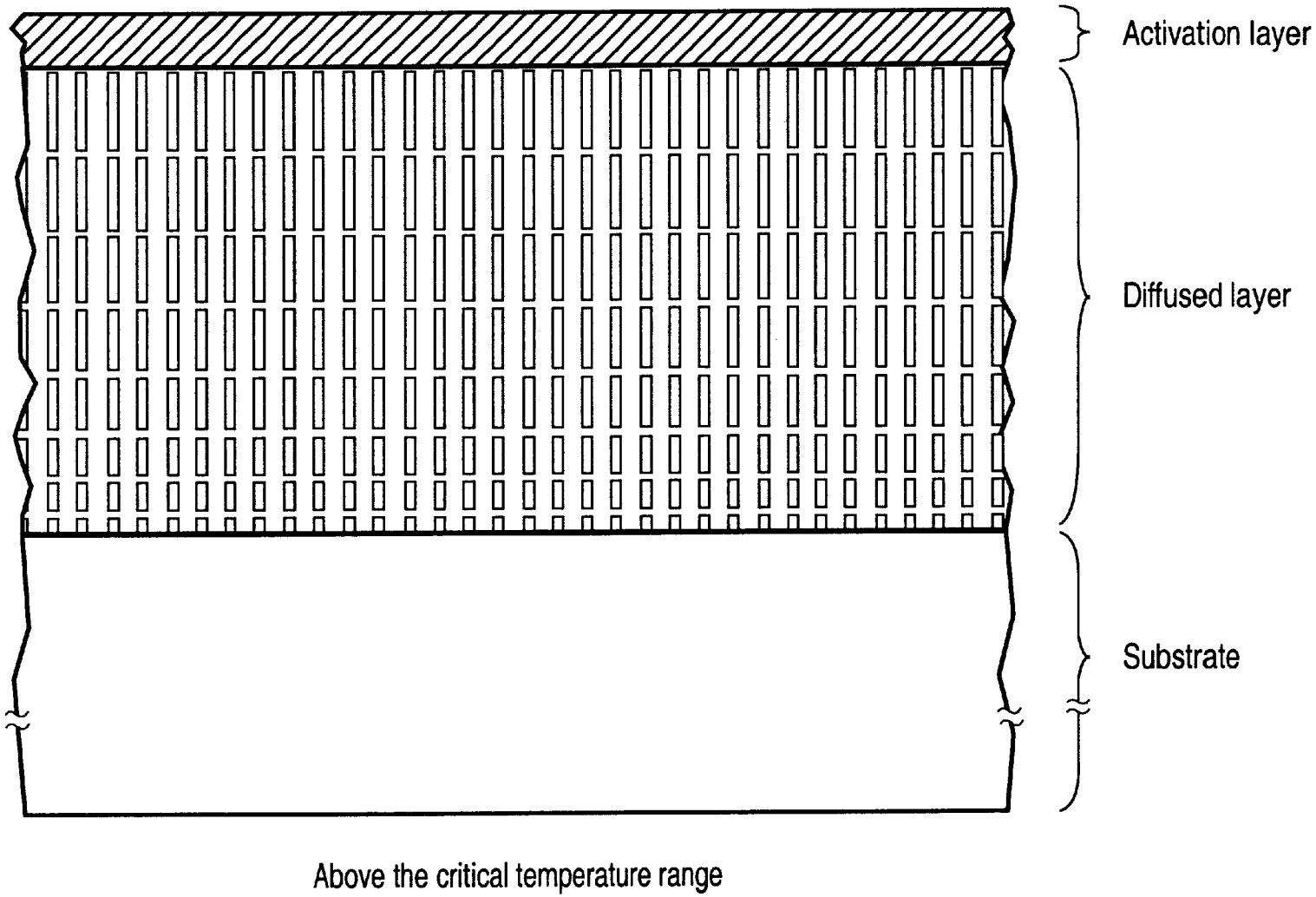
FIG. 9 is a schematic cross-section view of an Al—Ti—Si coating of the invention shown in FIGS. 5–8 after heating to a temperature above the final heat treatment critical temperature ranges.
Figure 10:
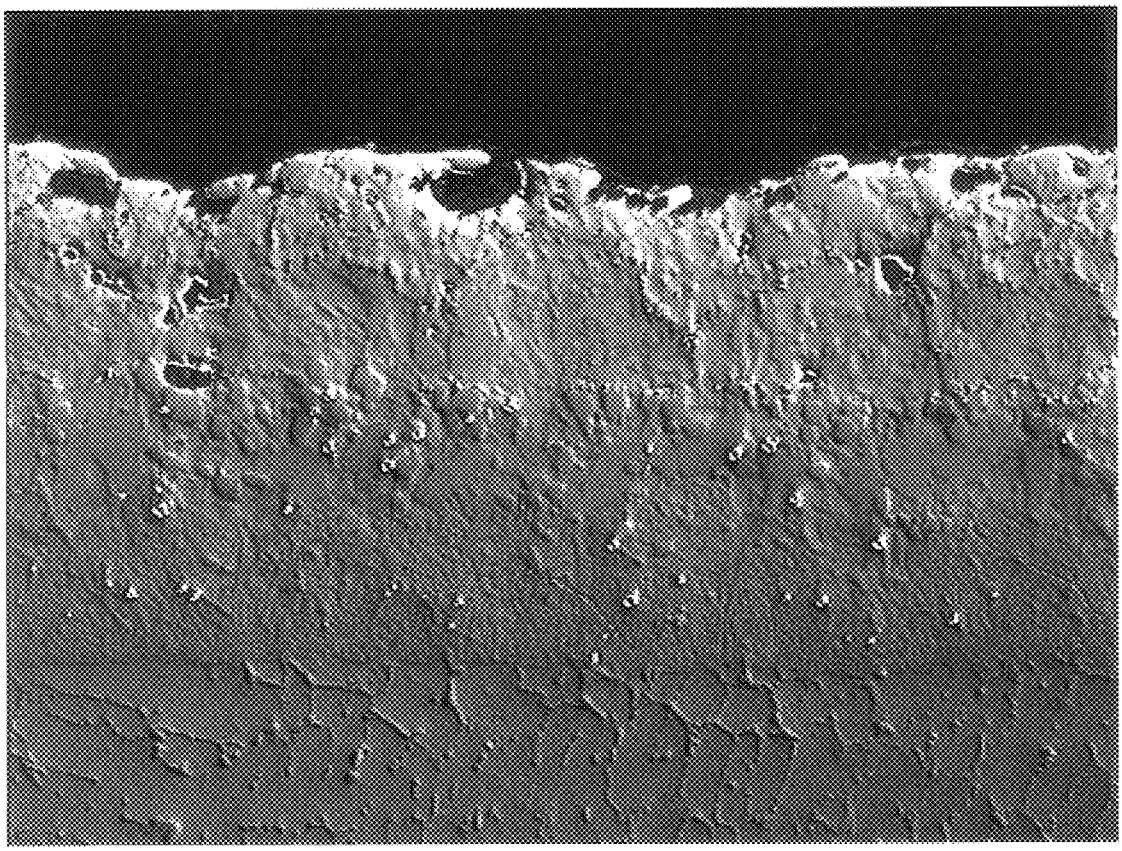
FIG. 10 is a photomicrograph of the microstructure of the alloy cross-section depicted in FIG. 9.

Between 1130° C. and 1150° C., the final segregation of the coating into layers occurs as typified in FIGS. 7 and 8. The final microstructure obtained is strongly dependent on the temperature, but not significantly dependent on the time spent at these temperatures, within the time range of at least about 20 minutes, preferably about 30 minutes to two hours. However, a different and less desirable microstructure results if the time at the final temperature is too short, for example, for only 10 minutes. At the lower end of this temperature range at 1130° C., void formation is still probable. The optimum temperature range for the final temperature soak is 1135° C. to 1145° C. for at least about 20 minutes, preferably about 30 minutes to 2 hours. At higher temperatures, the diffusion barrier that is formed as typified in FIGS. 9 and 10 becomes unstable, and at 1150° C., is quickly destroyed by inward diffusion of silicon. Above this temperature, aluminum diffusion downward also occurs, leaving a surface aluminum content below 5 percent, insufficient to maintain the alumina surface layer required for coking suppression.

The aluminum content of the coating can be reduced by up to about 10 wt. % by substitution with an equal weight percent of silicon, but at the expense of reducing the adhesion of the surface oxide at high temperature. The optimum maximum temperature is somewhat dependent on the composition of the coating. For example, when an equal weight-percentage of chromium is substituted for the titanium in the starting composition, the optimum maximum temperature is increased to within the range 1130° C. to 1160° C. and preferably within the range of 1140° C. to 1155° C.

If the base alloy is a wrought or cast low chromium alloy containing in the range of 20 to 25 wt. % chromium, the temperature ramp rate should be the same as for the higher chromium content base alloys, but the preferred peak temperature is within the range 1050° C. to 1080° C. In this situation, the chromium silicide-containing diffusion barrier does not form due to the low chromium concentration in the base alloy. Alloys with 20 to 25 wt. % chromium content include the Inco 800™ series alloys, for example 88H™, 800HT™ and 803™ alloys. The required minimum temperature ramp rate is not dependent on the base alloy composition.

In some cases in which molybdenum is substituted for a portion of the chromium in the base alloy to provide improved high temperature properties and at the same time preserve the ductility associated with alloys with a higher chromium content, the peak temperature for thermal treatment of the coating lies intermediate between that for the low chromium alloys and the alloys containing 33 wt. % or more chromium. For example, if the base alloy contains in the range of 20 to 25 wt. % chromium and about 3 wt. % molybdenum, the preferred peak temperature is in the range of 1130° C. to 1145° C. Similar optimum heat treatment conditions would be expected for low chromium alloys containing other refractory metals such as tungsten.

Another class of coatings of the invention provides a chromium oxide scale rather than an aluminum oxide scale. Chromia surfaces have been found to be almost as effective as alumina surfaces to prevent catalytic coke formation. Exemplary of this class of coating is one with a composition prior to heat treatment of 10 wt. % titanium, 40 wt. % chromium and 50 wt. % silicon. This coating does not develop a diffusion barrier layer, but rather forms an enrichment pool by enriching the silicon content of the surface of the base alloy. The silicon enrichment allows silica to form below the surface scale of chromia that ordinarily forms on the base alloy as it is surface oxidized. This reduces the rate at which chromium diffuses to the surface and reduces the rate at which carbon and oxygen diffuse downwards into the base alloy. The silicon content of the base alloy conventionally is limited to less than 2 wt. % so that it can be welded. When the silicon content in the enrichment pool is increased to the range of 6 to 10 wt. %, silica can form much more easily. The layer of silica underlying the surface chromia layer helps to stabilize the chromia layer. This reduces the rate at which additional chromium within the base alloy must diffuse to the surface to form new chromia, thus increasing the service life of the coated base alloy over that obtained with the uncoated alloy. Silicon also fills the interstices of the base alloy crystal lattice, thus inhibiting carbon diffusion into the base alloy, reducing mechanical failure due to carburization of the base alloy. Titanium may be added to improve the adhesion of the coating to the base alloy and chromium is added to reduce the activity of the silicon in the early stages of heat treatment before the peak temperature is reached.

The heat treatment following deposition of the coating is not critical as it is for the alumina forming coatings. The only requirement is that the peak temperature be between 1150° C. and 1155° C. for a time sufficient to produce an enrichment pool having a silicon content of at least 2.5 wt. %, preferably about 6 to 10 wt. %, at least 22 wt. % chromium, preferably 22 to 40 wt. % chromium and at 0 to 10 wt. % titanium. If the silicon content exceeds 10 wt. %, the surface alloy coating tends to become porous at its interface with the base alloy during high temperature service due to reaction between the silicon and chromium carbides in the base alloy, thus compromising the coating adherence.

The chromia forming surface alloy coatings have two layers including a chromia layer on top having a thickness in the range of 0.5 to 10 $\mu$m and an enrichment pool layer having a thickness in the range of 10 to 300 $\mu$m, preferably 120 to 150 $\mu$m.

The product and process of the invention will now be described with reference to the following non-limitative examples.

EXAMPLE 1

This example demonstrates the coking resistance of treated versus untreated tubes.

A laboratory scale unit for ethylene production was used to quantify the coking rate on the innerwall of an ethylene furnace tube by running the pyrolysis process for 2 to 4 hours or until the tube was fully plugged with coke, whichever occurred first. The test piece typically was 12 to 16 mm in outer diameter and 450 to 550 mm in length. The tube was installed in the unit and the process gas temperature monitored over its fill length to establish an appropriate temperature profile. Ethane feedstock was introduced to a steady state ratio of 0.3:1 of steam: hydrocarbon. The contact time used ranged from 100 to 150 msec and the cracking temperature was approximately 915° C. The sulfur level in the gas stream was approximately 25 to 30 ppm. The product stream was analyzed with a gas chromatograph to quantify product mix, yields and conversion levels. At the end of the run, the coke was burned off and quantified to calculate an average coking rate. After the decoke, the run typically was repeated at least once.

The results for 6 treated tubes are reported in Table III, identifying the coating materials used for the treatment and the tube innerwall surface being tested for coking resistance. Quartz is used as a reference representing a highly inert surface with no catalytic activity. The formation and collection of amorphous coke from the gas phase is considered independent of the catalytic coke formed at the tube surface and can account for up to 1 mg/min, depending on the collection area (surface area or roughness) at the tube surface. Therefore, a surface with no catalytic activity is expected to exhibit a coking rate of 0 to 1 mg/min due simply to the collection of amorphous coke. Differences within this range are considered unimportant and ascribable to differences in surface roughness. Metal reference tube runs are also shown with their test results taken from a database of the test unit. The 20Cr—30Ni—Fe metal reference alloy is considered the lowest alloy used in olefins manufacturing and exhibits the highest coking rate of 8 to 9 mg/min. With such a coking rate, the test tube is fully plugged (coked) in less than 2 hours. Higher alloys tested (richer in Cr and Ni) provide an improvement with a reduction in coking rate to 4 to 5 mg/min.

The results show that the metal treated tubes perform as good as the quartz reference tube. The remaining challenge, as described earlier, is in producing a surface alloy that exhibits excellent coking resistance, while also exhibiting the other properties required for commercial viability i.e., carburization resistance, thermal stability, hot erosion resistance and thermal shock resistance.

TABLE III

Pyrolysis Test Results of Treated and Untreated Tubes

| Tube Samples | Coating Materials | Major Surface Species in Test | Coking Rate (mg/min) |
|---|---|---|---|
| A | Si (treatment 1) | chromia & silica | 0.65, 0.64 |
| B | Si (treatment 2) | chromia & silica | 1.06; 1.02 |
| C | Ti—Si | chromia & titania | 0.48; 0.60 |
| D | Cr | chromia | 0.51; 0.73 |
| E | Cr—Ti—Si | chromia | 0.67; 0.66; 0.79 |
| F | Al—Ti—Si | alumina | 0.68; 0.38 |
| Quartz reference for A, B, C and D | none (untreated) | silica | 0.34; 0.40 |
| Quartz reference for E | none (untreated) | silica | 0.42; 0.36 |
| Quartz reference for F | none (untreated) | silica | 0.23 |
| Metal Reference 1 (20Cr-30Ni-Fe) | none (untreated) | mixture of bulk metals and their oxides | 8 to 9 (from database) |
| Metal Reference 2 (higher base alloys) | none (untreated) | mixture of bulk metals and their oxides | 4 to 5 (from database) |

EXAMPLE II

This example is included to demonstrate the lack of carburization following accelerated carburization and aging tests.

Two accelerated test methods have been used to evaluate carburization resistance. The first method (Accelerated Carburization Method 1) comprises a cycle of ~24h duration and consists of ethane pyrolysis at 870° C. for 6 to 8 hours to deposit carbon on the test piece surface, followed by an 8 hour soak at 1100° C. in a 70% hydrogen and 30% carbon monoxide atmosphere to diffuse the deposited carbon into the test piece, and finally, a coke burn off at 870° C. using steam/air mixtures and lasting 5 to 8 hours. Under these conditions, wrought tubing of the 20Cr—30Ni—Fe alloy composition with a 6 mm wall thickness typically carburizes through to one half of the wall thickness after 15 to 16 cycles. This level of carburization is normally seen at the end of the service cycle of tube products in commercial furnaces and can therefore be considered to represent one tube lifetime.

Figure 4:
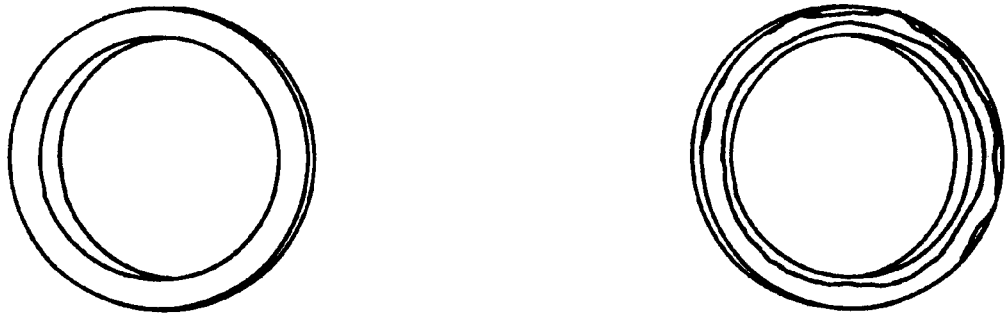
FIG. 4 is a photograph showing a treated sample (left) and an untreated sample (right) of the results of Method 1 accelerated carburization test after 22 cycles.

A total of 9 surface alloys have been tested using the above procedure. All of the surface alloys passed the test with either minimal or no carburization whatsoever. FIG. 4 shows one of the treated tubes (sample on left) showing excellent carburization resistance alongside an untreated tube after 22 cycles.

The second test method (Accelerated Carburization Method 2) used to evaluate carburization resistance is more severe than Method 1 in that a thick layer of carbon is initially painted on the test piece surface, followed with a hot soak at 1100° C. in a 70% hydrogen and 30% carbon monoxide atmosphere for 16 hours. The sample is removed from the test unit, additional carbon is repainted and the cycle is repeated. Three such cycles are sufficient to fully carburize the 6 mm wall thickness of untreated tubes of the wrought 20Cr—30Ni—Fe composition. The test is considered more severe than Method 1 due to the longer duration of the soak portion of the cycle, and because the test does not allow the surface to recover in any way with a protective scale. The surface alloys considered commercially viable have passed this test. The test is intended to provide a relative ranking.

EXAMPLE III

This example is included to demonstrate the superior hot erosion resistance of treated alloys.

Hot erosion resistance is carried out to evaluate scale adherence and erosion rates of surface alloyed components. Tube segments are heated to 8500° C. and are exposed to air. Erodent particles are propelled towards the test surface at a predefined speed and impact angle. The weight loss of the sample is quantified for a fixed load of particles (total dosage).

A total of five surface alloy—base alloy combinations have been tested. In all cases, as shown in Table IV, weight loss measurements show that the erosion resistance of surface alloyed components is 2 to 8 times that of untreated samples. The Al—Ti—Cr—Si systems on a cast alloy exhibited the lowest erosion rate of the systems tested.

TABLE IV

Hot Erosion Test Results

| Base Alloy | Coating Materials used for Surface Alloy | Weight Loss (mg) 30° impingement | Weight Loss (mg) 90° impingement |
|---|---|---|---|
| 20Cr-30Ni-Fe wrought | Cr-Ti-Si (sample A) | 8.9 | 7.4 |
| | (sample B) | 13.9 | 10.7 |
| | none (reference) | 45.3 | 57.8 |
| 35Cr-45Ni-Fe (cast, supplier A) | Al-Ti-Si | 4.9 | |
| | Cr-Ti-Si | 4.2 | |
| | None (reference) | 9.8 | |
| 35Cr-45Ni-Fe (cast, supplier B) | Al-Ti-Si | 1.2 | |
| | Cr-Ti-Si | 2.2 | |
| | None (reference) | 9.3 | |

EXAMPLE IV

This example is included to demonstrate the thermal stability of treated alloys.

Thermal stability testing is carried out to ensure the survivability of a surface alloy at the operating temperatures of commercial furnaces. Test coupons are annealed in an inert atmosphere at various temperatures in the range of 900 to 1150° C. for up to 200 hours at each temperature. Any changes in structure or composition are quantified and used to project the maximum operating temperature for a given surface alloy.

The results for the cast alloy 35Cr—45Ni—Fe from supplier B indicate that both the Al—Ti—Cr—Si and the Cr—Ti—Si systems can be operated at temperatures of up to 1100° C. A temperature of up to 1125° C. can be used for the Cr—Ti—Si system but may lead to a slow deterioration of the Al—Ti—Cr—Si system. The Cr—Ti—Si system begins to deteriorate at temperatures exceeding 1150° C. Olefins manufacturing plants generally use a maximum outer tube wall temperature of 1100° C., and in some cases operate below 1050° C.

EXAMPLE V

This example is included to demonstrate the thermal shock resistance of surface alloyed parts.

Thermal shock resistance testing is used to evaluate the ability of the surface alloy to withstand emergency furnace shutdowns in service when large temperature changes may occur over a very short time. The test rig evaluates tube segments by gas firing of the outerwall surface to a steady state temperature of 950 to 1000° C. for 15 minutes followed by rapid cooling to approximately 100° C. or lower in about 15 minutes. A test sample undergoes a minimum of 100 such cycles and is then characterized.

Both the Al—Ti—Cr—Si and the Cr—Ti—Si systems passed this test with no deterioration. The systems on the wrought tube alloy 20Cr—30Ni—Fe were tested for a total of 300 cycles with no deterioration observed. Untreated reference samples in all cases exhibited severe chromium loss after 100 cycles.

It will be understood, of course, that modifications can be made in the embodiments of the invention illustrated and described herein without departing from the scope and purview of the invention as defined by the appended claims.

We claim:

1. A method of providing a protective surface made up of a surface alloy on a base alloy containing iron, nickel, chromium and alloying additives comprising: depositing onto said base alloy a surface alloy comprised of an effective amount of silicon and at least one of aluminum, titanium and chromium and heat treating said base alloy with said surface alloy at a temperature in the range of 400 to 1160° C. to a desired maximum temperature to generate a surface alloy consisting of an enrichment pool which contains 2.5 to 30 wt. % silicon, 0 to 10 wt. % titanium, 2 to 45 wt. % chromium and 0 to 15 wt. % aluminum with the balance thereof being iron, nickel and any base alloying additives, whereby said enrichment pool is functional to reduce the deposition of catalytically formed coke thereon.

2. A method as claimed in claim 1, in which the base alloy with the surface alloy are heat-treated at a rate of temperature rise of at least 5 Celsius degrees/min. to the desired maximum temperature and in which the enrichment pool has a thickness in the range of 10 to 300 $\mu$m.

3. A method of providing a protective surface made up of a surface alloy on a base alloy containing iron, nickel, chromium and alloying additives comprising: depositing onto said base alloy a surface alloy comprised of about 35 to 45 wt. % aluminum, a total of about 5 to 20 wt. % of at least one of titanium and chromium, and about 40 to 55 wt. % silicon, and heat treating said base alloy with said surface alloy at a temperature in the range of 400 to 1160° C. to a desired maximum temperature for a time sufficient to generate a surface alloy consisting of an enrichment pool having a thickness in the range of 10 to 300 $\mu$m which contains 3 to 7 wt. % silicon, and 5 to 15 wt. % aluminum with the balance thereof being chromium, titanium, iron, nickel and any base alloying additives, whereby said enrichment pool is functional to reduce the deposition of catalytically formed coke thereon.

4. A method as claimed in claim 3, in which the base alloy and surface alloy are heat-treated at a rate of temperature rise of at least 5 Celsius degrees/min. to the desired maximum temperature and are maintained in a non-oxidizing atmosphere through at least the temperature rise of 500° to 750° C.

5. A method as claimed in claim 4, in which about 35 to 40 wt. % aluminum, about 5 to 15 wt. % titanium, and about 50 to 55 wt. % silicon are deposited onto the base alloy.

6. A method as claimed in claim 5, in which the base alloy contains about 31 to 38 wt. % chromium, and maintaining the base alloy at a desired maximum temperature in the range of about 1130 to 1150° C. for at least about 20 minutes.

7. A method as claimed in claim 6, further comprising reacting the protective surface with an oxidizing gas whereby a replenishable protective oxide scale of alumina having a thickness of about 0.5 to 10 $\mu$m is formed on said protective surface.

8. A method as claimed in claim 5, in which the base alloy contains about 31 to 38 wt. % chromium, and maintaining the base alloy at a desired maximum temperature in the range of about 1130 to 1150° C. for about 30 minutes to 2 hours.

9. A method as claimed in claim 4, in which about 40 wt. % aluminum, about 10 wt. % titanium and about 50 to 55 wt. % silicon are deposited onto the base alloy.

10. A method as claimed in claim 9, in which said surface alloy additionally comprises up to about 1.5 wt. % of yttrium, hafnium or zirconium added before heating of the base alloy to enhance the stability of said surface alloy.

11. A method as claimed in claim 4, in which about 40 wt. % aluminum, about 10 wt. % chromium, and about 50 to 55 wt. % silicon are deposited onto the base alloy.

12. A method as claimed in claim 11, in which the base alloy and surface alloy are maintained at about 1130° C. to about 1160° C. for at least about 20 minutes.

13. A method as claimed in claims 12, further comprising reacting the protective surface with an oxidizing gas whereby a replenishable protective oxide scale of alumina having a thickness of about 0.5 to 10 $\mu$m is formed on said protective surface.

14. A method as claimed in claim 12, in which the base alloy and surface alloy are maintained at about 1140° C. to about 1155° C. for about 30 minutes to 2 hours.

15. A method as claimed in claim 4 in which the base alloy with the surface alloy are heat treated in non-oxidizing atmosphere of a vacuum or an inert atmosphere.

16. A method as claimed in claim 3 which additionally comprises heat treating said base alloy and attendant surface alloy at a desired maximum temperature in the range of 1030 to 1150° C. for a time effective to form an intermediary diffusion barrier between the base alloy and the surface alloy containing intermetallics of the deposited elemental silicon, and one or more of titanium or aluminum, and the base alloy elements.

17. A method as claimed in claim 16, in which the diffusion barrier contains about 4 to 20 wt. % silicon, 0 to 5 wt. % aluminum, 0 to 4 wt. % titanium, and about 20 to 85% chromium, the balance thereof being iron and nickel and any alloying additives.

18. A method as claimed in claim 16, in which the diffusion barrier has a thickness in the range of about 10 to 300 $\mu$m.

19. A method as claimed in claim 17, further comprising reacting said protective surface with an oxidizing gas whereby a replenishable protective oxide scale is formed on said enrichment pool.

20. A method as claimed in claim 19, in which the oxidizing gas is selected from the group consisting of oxygen, air, steam, carbon monoxide and carbon dioxide, alone, or with any of nitrogen or argon.

21. A method as claimed in claim 16, in which the diffusion barrier contains about 6 to 10 wt. % silicon, 0 to 5 wt. % aluminum, 0 to 4 wt. % titanium, about 25 to 50 wt. % chromium, the balance thereof being iron and nickel and any base alloying additives.

22. A method as claimed in claim 16, in which the surface alloy comprises an enrichment pool which contains about 3 wt. % silicon and about 5 wt. % aluminum and a diffusion barrier which contains about 6 wt. % silicon and about 20 wt. % chromium.

23. A method as claimed in claim 16, in which the base alloy contains about 31 to 38 wt. % chromium, and maintaining the base alloy at a desired maximum temperature in the range of about 1135 to 1145° C. for at least about 20 minutes.

24. A method as claimed in claim 16, in which the base alloy contains about 31 to 38 wt. % chromium, and maintaining the base alloy at a desired maximum temperature in the range of about 1135 to 1145° C. for about 30 minutes to 2 hours.

25. A method as claimed in claim 16, in which the base alloy contains about 31 to 38 wt. % chromium and in which the surface alloy deposited on said base alloy comprises about 40 to 45 wt. % aluminum, a total of about 8 to 15 wt. % of at least one of titanium and chromium, about 45 to 50 wt. % silicon and about 0.25 to 1 wt. % yttrium, and the base alloy and surface alloy are heat treated at a desired maximum temperature in the range of 1140 to 1150° C. for at least about 20 minutes.

26. A method as claimed in claim 25, which the base alloy and surface alloy are heat treated at said desired maximum temperature for about 30 minutes to 2 hours.

27. A method as claimed in claim 16, in which the base alloy contains about 20 to 25 wt. % chromium and in which the surface alloy deposited on said base alloy comprises about 40 to 45 wt. % aluminum, a total of about 8 to 15 wt. % of at least one of titanium and chromium, about 45 to 50 wt. % silicon and about 0.25 to 1 wt. % yttrium, and the base alloy and surface alloy are heat treated at a desired maximum temperature in the range of 1050 to 1080° C. for at least about 20 minutes.

28. A method as claimed in claim 27, in which the base alloy and surface alloy are heat treated at said desired maximum temperature for about 30 minutes to 2 hours.

29. A method as claimed in claim 3, in which said surface alloy additionally comprises up to about 1.5 wt. % of yttrium, hafnium or zirconium added before heating of the base alloy to enhance the stability of said surface alloy.

30. A method as claimed in claim 3, in which the rate of temperature rise is in the range of 10 to 20 Celsius degrees/min.

31. A method as claimed in claim 3 in which the base alloy and surface alloy are heated in a furnace, and the furnace is preheated to the desired maximum temperature whereby the rate of temperature rise of the surface alloy is greater than 20° C./min.

32. A method as claimed in claim 31, which the base alloy with the surface alloy are heat treated in air.

33. A method as claimed in claim 3, in which the base alloy contains about 20 to 25 wt. % chromium, depositing onto the base alloy about 15 to 40 wt. % aluminum, about 5 to 15 wt. % titanium and the balance silicon, and maintaining the base alloy at a desired maximum temperature in the range of about 1050 to 1080° C. at least about 20 minutes.

34. A method as claimed in claim 3, in which the base alloy contains about 20 to 25 wt. % chromium, depositing onto the base alloy about 15 to 40 wt. % aluminum, about 5 to 30 wt. % titanium and the balance silicon, and maintaining the base alloy at a desired maximum temperature in the range of about 1050 to 1080° C. for about 30 minutes to 2 hours.

35. A method as claimed in claim 3, in which the base alloy contains about 20 to 25 wt. % chromium and additionally contains about 3 wt. % molybdenum, depositing onto the base alloy about 40 wt. % aluminum, about 10 wt. % titanium and the balance silicon, and maintaining the base alloy at a desired maximum temperature in the range of about 1130 to 1145° C. at least about 20 minutes.

36. A method as claimed in claim 3, in which the base alloy contains about 20 to 25 wt. % chromium and additionally contains about 3 wt. % molybdenum, depositing onto the base alloy about 40 wt. % aluminum, about 10 wt. % titanium and the balance silicon, and maintaining the base alloy at a desired maximum temperature in the range of about 1130 to 1145° C. for about 30 minutes to 2 hours.

37. A method as claimed in claim 3, in which the surface alloy is deposited by thermal spraying.

38. A method of providing a protective surface made up of a surface alloy on a base alloy containing iron, nickel, chromium and alloying additives comprising: depositing onto said base alloy a surface alloy comprised of about 40 to 50 wt % chromium and about 40 to 50 wt % silicon, the balance titanium, and heat-treating said base alloy with said surface alloy at a temperature in the range of 400 to 1160° C. at a rate of temperature rise of at least 5 Celsius degrees/min. to a desired maximum temperature for a time sufficient to generate a surface alloy consisting of an enrichment pool which contains at least 22 wt % chromium, at least 2.5 wt % silicon, 0 to 10 wt % titanium with the balance thereof being iron, nickel and any base alloying additives, whereby said enrichment pool is functional to reduce the deposition of catalytically formed coke thereon.

39. A method as claimed in claim 38, which additionally comprises heat-treating the base alloy with the surface alloy at a desired maximum temperature in the range of 1150° to 1155° C. for a time sufficient to produce an enrichment pool containing about 6 to 10 wt % silicon.

40. A method as claimed in claim 39, in which the enrichment pool has a thickness in the range of 10 to 300 $\mu$m.

41. A method as claimed in claim 34, in which about 40 to 50 wt. % chromium, about 0 to 10 wt. % titanium and about 40 to 50 wt. % silicon, are deposited onto the base alloy, and maintaining the base alloy at a maximum temperature in the range of about 1150 to 1155° C. for about 30 minutes to 2 hours.

42. A method as claimed in claim 39, in which about 40 wt. % chromium, about 10 wt. % titanium and about 50 wt. % silicon are deposited onto the base alloy, and maintaining the base alloy at a maximum temperature in the range of about 1150 to 1155° C. for about 30 minutes to 2 hours.

43. A method as claimed in claim 38, in which about 40 wt. % chromium, about 10 wt. % titanium and about 50 wt. % silicon are deposited onto the base alloy, and maintaining the base alloy at a maximum temperature in the range of about 1150 to 1155° C. for at least about 20 minutes.

44. A method as claimed in claim 38, additionally comprising maintaining an inert atmosphere or a vacuum environment at least during heat treating of the base alloy and the surface alloy through the temperature-range of about 500° C. to about 750° C.

45. A method as claimed in claim 38, in which said surface alloy additionally comprises up to about 1.5 wt. % of yttrium, hafnium or zirconium added before heating of the base alloy to enhance the stability of said surface alloy.

46. A method as claimed in claim 38, in which the rate of temperature rise is in the range of 10 to 20 Celsius degrees/min.

47. A method as claimed in claim 38, in which the base alloy and surface alloy are heated in a furnace, and the furnace is preheated to the desired maximum temperature Thereby the rate of temperature rise of the, surface alloy is greater than 20° C./min.

48. A method as claimed in claim 38, further comprising reacting said protective surface with an oxidizing gas whereby a replenishable protective oxide scale is formed on said enrichment pool.

49. A method as claimed in claim 40, in which the oxidizing gas is selected from the group consisting of oxygen, air, steam, carbon monoxide and carbon dioxide, alone, or with any of nitrogen, hydrocarbons or argon.

50. A method as claimed in claim 38, further comprising reacting said protective surface with an oxidizing gas whereby a replenishable protective oxide scale of chromia is formed having a thickness of about 0.5 to 10 $\mu$m on said enrichment pool.

* * * * *